US005217224A

United States Patent [19]

Sincock

[11] Patent Number: 5,217,224

[45] Date of Patent: Jun. 8, 1993

[54] PRIZE AWARD SYSTEM FOR COIN LAUNDRY

[76] Inventor: Brent Sincock, 10732 Overman Ave., Chatsworth, Calif. 91311

[21] Appl. No.: 787,943

[22] Filed: Nov. 5, 1991

[51] Int. Cl.[5] ..... A63F 9/24

[52] U.S. Cl. ..... 273/138 A; 273/460

[58] Field of Search ..... 273/459, 460, 139, 138 A, 273/138 R, 148 A

[56] References Cited

U.S. PATENT DOCUMENTS

| | | | |
|---|---|---|---|
| 2,361,977 | 11/1944 | Stair | 273/138 A |
| 3,138,385 | 1/1960 | Giacobello | 273/138 A |
| 3,594,760 | 7/1971 | Haker | 273/138 A |
| 4,013,157 | 3/1977 | Britz et al. | 273/138 A |
| 4,202,468 | 5/1980 | Anderson et al. | 226/68 |
| 4,258,838 | 3/1981 | Rockola et al. | 273/138 A |
| 4,685,677 | 8/1987 | Demar et al. | 273/460 |
| 4,993,714 | 2/1991 | Golightly | 273/138 A |

FOREIGN PATENT DOCUMENTS

| | | | |
|---|---|---|---|
| 3020226 | 12/1981 | Fed. Rep. of Germany | 273/138 A |
| 2123702 | 2/1984 | United Kingdom | 273/138 A |
| 2201279 | 8/1988 | United Kingdom | 273/143 R |
| 2211975 | 7/1989 | United Kingdom | 273/138 A |

*Primary Examiner*—Jessica J. Harrison

*Attorney, Agent, or Firm*—Christie, Parker & Hale

[57] ABSTRACT

An apparatus and method for awarding prizes to equipment users during off-peak hours of an establishment. A plurality of machines, such as coin laundry washing machines or dryers, are all coupled through an activity interface to a master control unit. The master control unit comprises a timer, a counter, a display, and signal means to signal award of a prize. The timer runs until a preset time interval expires, and then triggers the counter to select a random number representing one of the machines coupled to the master control unit. The master control unit determines whether the selected machine is operating by querying the activity interface corresponding to the selected machine. If the machine is operating, the signal means is triggered to audibly or visually award a prize. If the selected machine is not operating, another machine is selected at random. The process continues until an operating machine is selected. After a prize is awarded, the master control unit idles until it is reset, causing the timer to begin running again.

23 Claims, 5 Drawing Sheets

PRIZE AWARD SYSTEM FOR COIN LAUNDRY

FIELD OF THE INVENTION

This invention generally relates to electronic apparatus and methods for awarding prizes to users of machines in commercial establishments. The invention specifically relates to circuitry and methods for randomly awarding prizes to off-peak-hour users of machines in retail coin laundry establishments.

BACKGROUND OF THE INVENTION

Typically coin laundries operate at peak capacity only on a few days and hours, such as weekend days and weekday evenings. Other businesses experience a wide variance of business at different times of the business day or week. Operators of coin laundry establishments, and others similarly situated, desire apparatus and methods to induce customers to patronize the establishment and its coin laundry equipment.

Offering prizes is a well known way of inducing business in any establishment. Operators of coin laundry establishments desire to use prize offerings but also desire to offer prizes only at off-peak hours.

Such operators also desire automatic, electronic means for awarding prizes so that prize awards can be made without requiring the attention of an attendant.

Prior patents relate to certain game methods for vending machines and other apparatus. For example, U.S. Pat. No. 3,651,987 (Powell) provides a plurality of timers each connected to one of a plurality of switching elements. Upon expiration of each timer, one of the switching elements is advanced. When the switching elements are aligned in a predetermined sequence, a prize or vending item is awarded. However, Powell does not disclose means for sensing external machine operation.

U.S. Pat. No. 3,168,178 (Stone et al.) provides a claim meter and "last load" circuitry for a coin-operated commercial laundry operation. After a predetermined number of cycles, the apparatus will halt operation of the cleaner and signal an operator that maintenance is needed. However, there is no correlation of the signal and the time of day for use of the machine.

U.S. Pat. No. 4,555,639 discloses a single controller connected to multiple laundry machines. The device enables a single coin acceptor to control a plurality of washing machines selected using push buttons.

U.S. Pat. No. 3,961,231 provides a controlled chemical injecting system for a plurality of washing machines. The apparatus includes a circuit for inhibiting a fluid injection signal if a machine is already in use.

U.S. Pat. No. 4,712,049 (Houserman) provides circuitry for detecting whether a vending system has completed an operation. The apparatus includes a detector circuit with a monitor connected to all the vending machine motors, to respond to the motors when a movement cycle is complete. The apparatus is not coupled to a time of day detector. Thus, the prior art fails to show an apparatus for awarding a prize to a user of a machine in which the odds of winning the prize increase during off-peak hours when fewer machines are in operation.

SUMMARY OF INVENTION

Accordingly, the present invention provides an apparatus and method for awarding prizes to equipment users during off-peak hours of an establishment. A plurality of machines, such as coin laundry washing machines or dryers, are each coupled through an activity interface to a master control unit. The master control unit comprises a timer, a counter, a display, and signal means to signal award of a prize. The timer runs until a preset time interval expires, and then triggers the counter to select a random number representing one of the machines coupled to the master control unit. The master control unit determines whether the selected machine is operating by querying the activity interface corresponding to the selected machine. If the machine is operating, the signal means is triggered to audibly or visually award a prize. If the selected machine is not operating, another machine is selected at random. The process continues until an operating machine is selected. After a prize is awarded, the master control unit idles until it is reset, causing the timer to begin running again.

DETAILED DESCRIPTION

In the following detailed description of the preferred embodiments, specific terminology is used for the sake of clarity. However, the invention is not limited to the specific terms selected, but rather includes all technical equivalents functioning in a substantially similar manner to achieve a substantially similar result.

Figure 1:
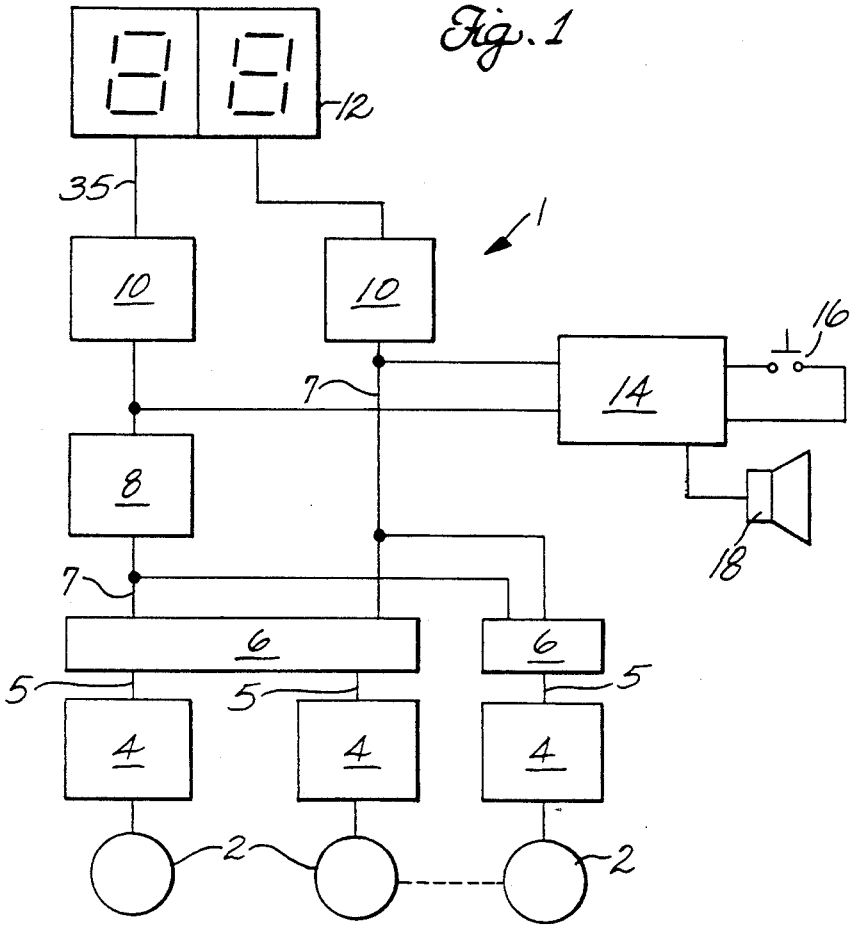
FIG. 1 is a block diagram of a prize award apparatus according to the invention.

FIG. 1 illustrates in block form an apparatus 1 for awarding prizes to users of a plurality of machines 2 such as washing machines or dryers in a commercial coin laundry establishment. Each machine is coupled to an activity interface means 4 for providing an active signal when the machine is operating. A plurality of the interfaces are coupled to one of a plurality of multiplexers 6 which provide a digital numeric output on lines 7 representing which of the machines is currently active.

One of the multiplexers is coupled to a decoder 8 which separates the most significant digit of the output of the multiplexers. The other multiplexer and the decoder are each coupled to one of two display drivers 10 which are each coupled to a display 12. The display can comprise a conventional 7-segment light emitting diode (LED) display.

A controller 14 is coupled in the circuit between the multiplexer and decoder and the display drivers. The controller is activated by a reset switch 16. The controller contains circuitry for selecting a random number representing one of the machines connected to the apparatus. After selecting the random number, the control means activates logic for determining whether the machine corresponding to the selected random number is active. If so, other logical circuitry in the control means causes an external audible signal or visual display 18 to be activated.

Figure 3:
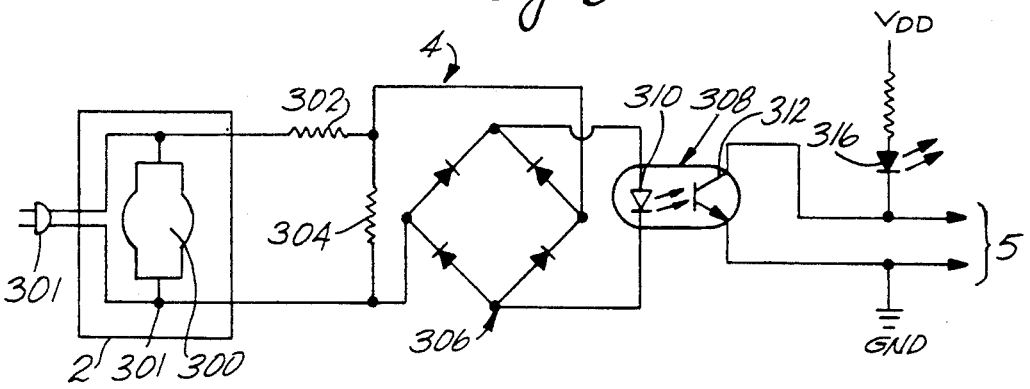
FIG. 3 is a schematic diagram of a machine activity interface used in the invention.

The activity interfaces may comprise the circuit of FIG. 3. As indicated, a conventional washing machine or clothes dryer 2 includes a motor 300 coupled to a high-voltage line 301. An interface circuit 4 can be coupled across the motor terminals 301 to provide sensing of whether a voltage exists across the motor and, thus, whether the machine is in operation. A current limiting resistor 302, and a voltage limiting resistor 304 reduce the current and voltage level coming from the motor; the voltage is applied to a bridge rectifier 306 comprising four diodes arranged in manner known in the art. As is known in the art, the bridge rectifier produces a direct current rectified output which may be applied to a light emitting diode 310 in an optoisolator 308. When the LED is energized, it illuminates a photo transistor 312 which is coupled across a supply voltage VDD and ground GND, and which begins to conduct. Consequently, a positive voltage exists across the output 5. This output voltage can be routed to the circuit of FIG. 2, and can be fed to a visible light emitting diode 316. Thus, when motor 300 is operating, a positive voltage is presented at the output 5 and LED 316 will be illuminated.

Figure 4:
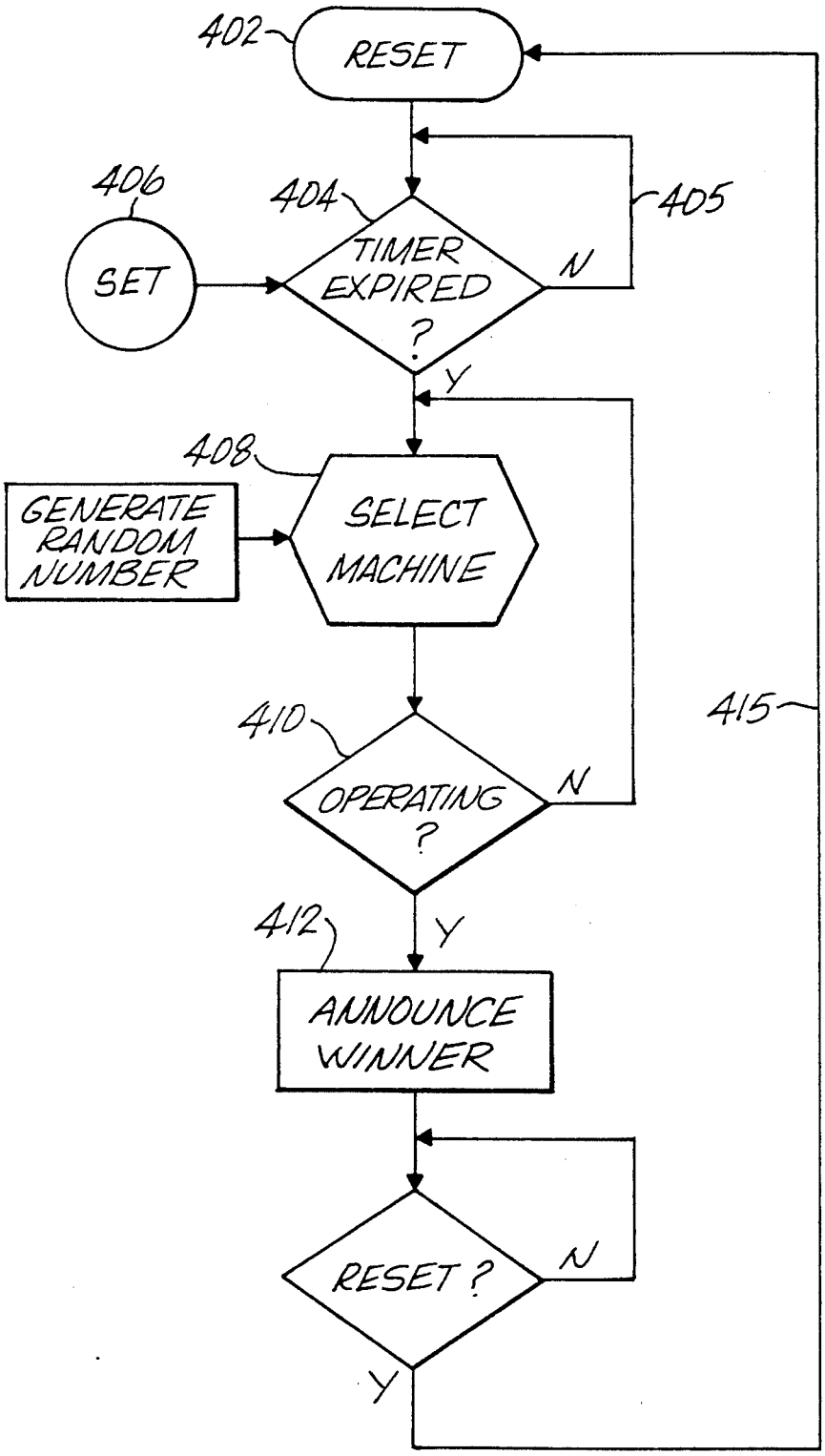
FIG. 4 is a flow diagram of a prize award method of the invention.

FIG. 4 illustrates a method of awarding a prize using the apparatus of the invention. Initially, the circuit is reset at step 402 by pressing the manual reset button 16. Control is passed to step 404 in which the apparatus tests whether an internal timer in the controller has expired. If not, control is passed back to the test of step 404, and this cyclic test continues (arrow 405) until the timer expires.

As indicated in step 406, the timer is preset with a time interval. Preferably, the timer is set with a longer time interval during peak hours of operation, and a short time interval during off-peak intervals. As a result, the odds of winning a prize using the apparatus increase during off-peak hours and decreased during peak hours. Thus, the apparatus serves to induce customers to patronize the establishment during off-peak hours.

When the timer expires (step 404 is true), control is passed to step 408 in which the controller selects one of the machines to which the controller is coupled. This can be accomplished using a random number generator 409 to generate an integer between one and n where n represents the number of machines in the commercial establishment. Control is passed to step 410 in which the selected machine is queried to determine whether it is operating. If a positive voltage is provided at the output of a circuit such as that of FIG. 3, the machine is operating and control passes to step 412. Otherwise, control is passed back to step 408 in which a new machine is selected and tested.

At step 412, a winner is announced using an audible alarm, such as a bell, or a visual indicator such as a light emitting diode display or a strobe light. Other attention-getting devices convention in the art may be used to announce the winner. Control is passed to step 414 in which the apparatus tests whether the reset button 16 has been pressed. This test continues until the button is pressed, when control is passed back to step 402. The loop established in FIG. 4 by arrow 415 will continue as long as power is applied to the apparatus.

Figure 2A:
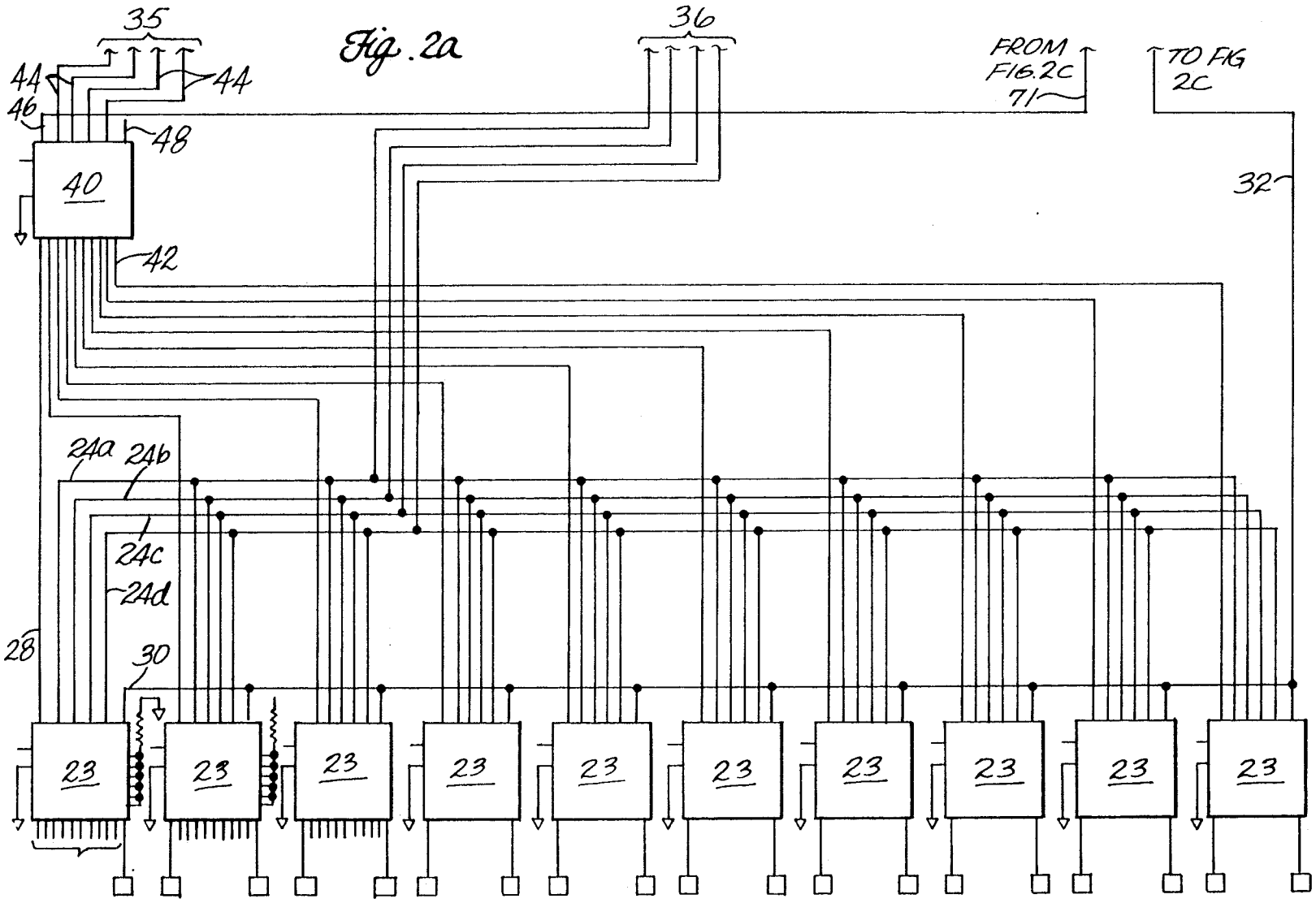
FIGS. 2*a* to 2*c* are detailed schematic diagrams of one embodiment of the invention.
Figure 2B:
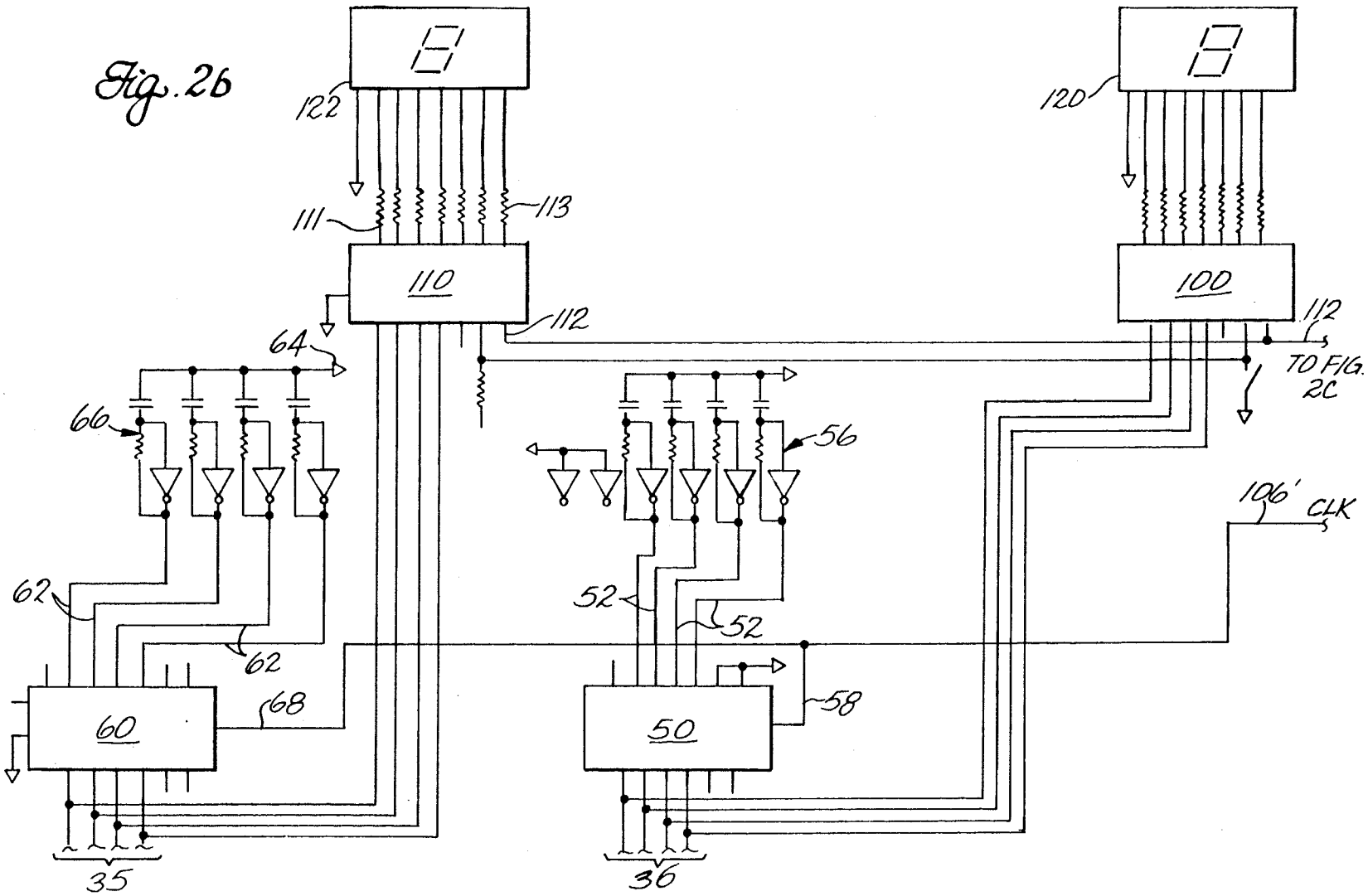
Figure 2C:
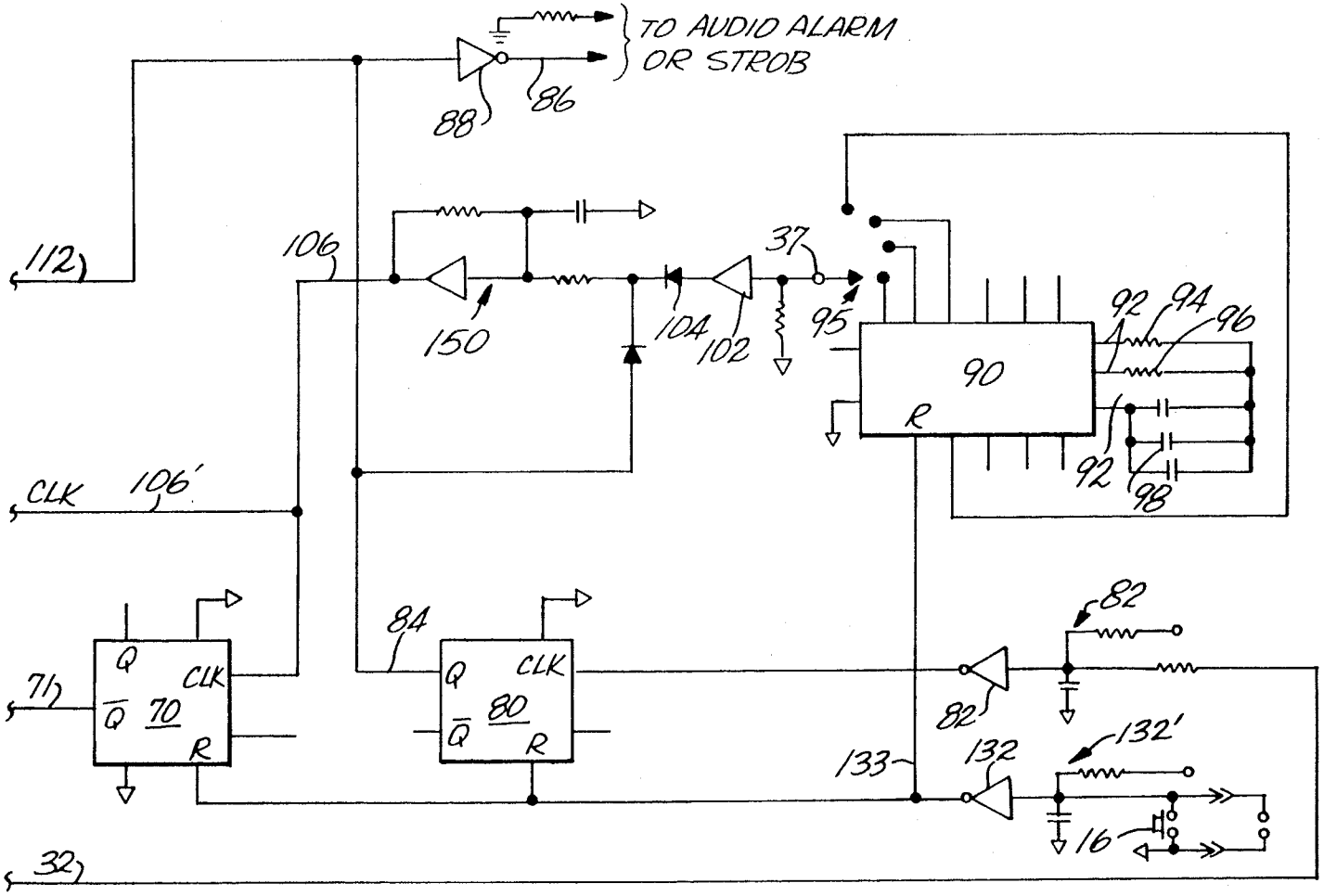

FIGS. 2*a* to 2*c* provide a detailed circuit diagram of one embodiment of the present invention. The output of a plurality of interface circuits such as those of FIG. 3 are fed as inputs 22 to a plurality of sixteen channel analog demultiplexers 23. The demultiplexers may be implemented using CMOS integrated circuits of type 4067 (CD4067 commercially available from Digi-Key). As is known in the art, such integrated circuits have a total of sixteen input lines 22 and six output lines. Four of the output lines 24*a*–24*d* provide a four bit digital representation of the analog inputs. Thus, if the analog inputs are above a predetermined analog voltage level, the input is considered "on" and contributes to the binary output. An inhibit input line 28 is provided, and when set to a logic high, inhibits the output of the multiplexer. A single output line 30 is provided and is set high by the multiplexer when a digital number is present on lines 26.

As the drawing indicates, a plurality of multiplexers may be used, each coupled to ten activity interfaces of FIG. 3 and thereby coupled to ten washing machines, dryers, or other devices. The remaining inputs 25 are unused and tied to ground. Each multiplexer 23 if FIG. 2*a* is wired in a similar manner. Thus, a first multiplexer will handle inputs from washing machines numbered 0 through 9 the second multiplexer will handle 10 through 20, etc., with a maximum of ninety-nine machines accommodated by the embodiment of FIGS. 2*a*–2*c*.

The inhibit line 28 of each of the multiplexers is coupled to a different input of a 16:4 decoder integrated circuit 40. The decoder may be implemented using a CMOS integrated circuit of type 4515, commercially available from Digi-Key. As is known in the art, the type 4515 circuit has sixteen digital inputs 42 each of which may be set to a logic 1 or 0, and produces a 4-bit digital representation of the inputs on four output lines 44. Also, the decoder 40 is provided with an inhibit line 46 which, if set to a logic 1, will inhibit any output from the circuit. A strobe line 48, preferably tied to the positive supply voltage in the preferred embodiment, enables triggering of the output.

The 4-bit output of the decoder is coupled in a digital output bus 35 which is fed as an input to a 6-input flip-flop device 60 shown in FIG. 2*b*. The flip-flop may be implemented as a commercially available CMOS integrated circuit of type 40174. As shown in the drawing, the digital inputs 62 are preferably tied to ground 64 through buffer circuitry 66. A clock input 68 is provided which is described in detail below.

The digital output bus 35 is also tied to a first display driver circuit 110. The display driver may be implemented with any of several commercially available integrated circuits for driving a 7-segment LED display 122 from a 4-bit digital input. As is known in the art, such a circuit receives a 4-bit digital number as an input and translates the number into 7 separate analog output voltages on lines which may directly drive a 7-segment LED display device 122 through current limiting resistors 113. The display drivers also include a blanking input 112 which, if set to a logic 1 will cause all the display segments to go dark.

The 4-bit output of the multiplexers, is likewise fed on a bus 36 to a second flip-flop 50 wired in a manner similar to flip-flop 60.

The bus 36 is also coupled to a display driver 100 which may a device identical to the display driver 110. The output of the second display driver feeds a second digital display 120. One of ordinary skill in the art will recognize that this arrangement of parts enables the first digital display to show the most significant decimal digit of a two-digit integer corresponding to the selected washing machine or device. The second display 120 shows the least significant decimal digit of the selected number. Thus this embodiment can display numbers for up to 99 separate machines.

The invention also includes a controller having a timer, a random number generator responsively coupled to the timer for generating a random number corresponding to one of the washing machines or devices upon expiration of the timer, and logic means coupled to the random number generator for testing whether the device corresponding to the random number is operating and, if so, for triggering the prize announcement means.

As indicated in FIG. 2*c*, the controller can comprise a first monostable 70, second monostable 80, and a counter 90. Other support circuitry is shown in the drawing.

The counter may be a CMOS integrated circuit of type 4060, commercially available from RCA. As is known in the art, the type 4060 counter includes three inputs 92 at pins 9, 10, and 11 for setting the time interval of the counter. Ordinarily, a resistor-capacitor (RC) network is coupled to pins 9, 10, and 11. In the preferred embodiment, a 680k ohm resistor 94 is coupled between pin 11 and the rest of the network. A 330k ohm resistor 96 is coupled between pin 10 and the rest of the network. Three capacitors 98 of values 0.1 microfarad, 0.68 microfarads, and 0.47 microfarads are coupled in parallel between pin 9 and the rest of the network. A rotary switch 95 is provided to enable selection of a time interval from among one of a plurality of outputs of the counter. As indicated, the rotary switch may be a single pole, three-throw type in which each of the throw selections is coupled to a separate output of the counter.

In this manner, depending on the selected setting, an output will be presented at the pole 97 of the switch when the specified time delay has expired. The output on the pole of the switch is fed through a buffer 102 and a diode 104 to a clock output line 106. The clock signal is coupled to the flip-flops 50, 60 on line 106' and therefore triggers resetting of the flip-flop states. The clock line 98 is also coupled to the monostable 70. The negative output of the monostable (not Q) is coupled on a line 71 to the inhibit line 46 of the decoder 40. Thus, when the counter 90 expires, the monostable 70 is triggered on the clock line, causing the inhibit line to be set, thereby inhibiting any further output from the decoder.

Suitable compensating capacitors and resistors 82', 132' (with values readily known to one of skill in the art) are provided. Each of the output lines 30 of the multiplexers is coupled together in a trigger input 32 (FIG. 2*a*). The trigger input is fed through a buffer 82 to the clock input of the monostable 80. The positive output of the monostable (Q) is tied to a display trigger line 84. The display trigger line is coupled to the blanking input of the display drivers. Accordingly, when a digital number is presented on input lines 26 to the multiplexers, and the corresponding washing machine is found to be operating, a signal will be set on the trigger input 32. This signal is presented to the clock input of the monostable, causing the positive output to be set, thereby triggering the display drivers to cancel blanking and display digits on the displays. Also, the trigger line can optionally be coupled to an alarm line 86 through a buffer 88 and thereby drive an external audio alarm, strobe light, etc.

A reset switch 16, preferably a momentary - type push button, is coupled to a reset line 133 of the counter, and the first and second monostables through a reset buffer 132. Depressing the reset switch pulls the reset lines and buffer to ground and, as is known in the art, causes the counter and monostables to reset.

Thus, the embodiment of FIGS. 2*a* to 2*c* provides a complete system for causing a timed delay of a predetermined period, generating a random number upon expiration of the timer, testing whether a washing machine or other device corresponding to the random number is in operation, and if so, triggering an alarm or visual display. The counter 90 operates as a timing means. The flip-flops 50, 60 act as random number generators. The first monostable 70, the multiplexers 4, and the interface modules operate as testing means to determine whether a machine is in operation. The second monostable 80 operates as a triggering means for turning the display drivers on when a machine is found to be operating. The trigger line 32 acts as a feedback path to trigger the second monostable when any of the machines is operating.

Preferably the system operates using a +12 volts d.c. supply from a conventional power supply. A suitable filtered, regulated direct current supply comprises, as is known in the art, a step-down transformer, bridge rectifier, solid-state three-terminal regulator such as the LM7812, and a plurality of filter capacitors.

The invention may be practiced in many ways other than as specifically disclosed herein. For example, other digital timer and logic circuits can be used to carry out the functions of the invention. Thus, the scope of the invention should be determined from the appended claims, in which:

What is claimed is:

1. Apparatus for awarding to users of a plurality of devices, comprising:

interface means coupled to each of the devices for providing an active signal when the device is operating;

prize announcement means for identifying a prize winner;

control means coupled to the interface means and the prize announcement means comprising a timer, a random number generator responsively coupled to the timer for generating a random number corresponding to one of the devices upon expiration of the timer, and logic means coupled to the random number generator for testing whether the device corresponding to the random number is operating, and if so, for triggering the prize announcement means.

2. Apparatus of claim 1, wherein the interface means comprises an interface circuit coupled to a source of power in one of the devices, the interface circuit comprising a rectifier for feeding current to an optoisolator, thereby providing an active signal when the device is operating.

3. Apparatus of claim 1, wherein the prize announcement means comprises a plurality of audible and visual signaling devices.

4. Apparatus of claim 3, wherein the visual signaling device comprises at least one digital display means for displaying a number corresponding to a winning device.

5. Apparatus of claim 1, wherein the prize announcement means comprises at least one digital display means for displaying a number corresponding to a winning device.

6. Apparatus of claim 1, wherein the timer comprises a digital timer integrated circuit.

7. Apparatus of claim 1, wherein the random number generator comprises a plurality of flip-flop circuits coupled to the timer, the flip-flops being coupled to a plurality of activity input lines from the devices, the flip-flops having a trigger input from the timer and a digital output activated in response to the trigger input.

8. Apparatus of claim 1, wherein the logic means comprises first and second monostables each coupled to a buffered clock input from the timer, the first monostables having an output coupled to a display decoder, the second monostable having an output coupled to the prize announcement means.

9. Apparatus for awarding prizes to users of a plurality of devices, comprising:

interface means coupled to each of the devices for providing an active signal when the device is operating;

prize announcement means for announcing a prize winner;

control means coupled to the interface means and the prize announcement means comprising a timer, a random number generator responsively coupled to the timer for generating a random number corresponding to one of the devices upon expiration of the timer, and logic means coupled to the random number generator for testing whether the device corresponding to the random number is operating, and if so, for triggering the prize announcement means, further including time of day sensing means for setting a time delay amount of the timer longer during off-peak hours of the devices.

10. Apparatus of claim 9, wherein the time of day sensing means comprises a real time clock providing a digital output corresponding to the actual time of day, and interval selection means coupled to the clock and to the timer for setting the timer to a long time interval when the digital output of the real time clock is equal to a preset off-peak time.

11. A prize award method, in a system comprising a plurality of devices comprising interface means coupled to each of the devices for providing an active signal when the device is operating; prize announcement means for identifying a prize winner; and control means coupled to the interface means comprising a timer, a random number generator responsively coupled to the timer, and logic means coupled to the random number generator for testing whether the device corresponding to the random number is operating, the method comprising the steps of:

setting a time interval in the timer;

running the timer until expiration of the time interval;

generating a random number corresponding to one of the devices upon expiration of the timer using the random number generator;

using the logic means to test whether the device corresponding to the random number is operating, and if so, for triggering the prize announcement means.

12. The method of claim 11, wherein the time interval is inversely related to customer traffic in the establishment.

13. The method of claim 11, wherein the time interval is longer during off-peak hours in the establishment.

14. A prize award method, in a system comprising a plurality of machines in a commercial laundry establishment, each machine being coupled to interface means for providing an active signal when the machine is operating, prize announcement means for identifying a prize winner, and control means coupled to the interface means comprising a timer, a random number generator responsively coupled to the timer, and logic means coupled to the random number generator for testing whether the machine corresponding to the random number is operating, the method comprising the steps of:

setting a time interval in the timer;

running the timer until expiration of the time interval;

generating a random number using the random number generator, the random number corresponding to one of the machines upon expiration of the timer;

using the logic means to test whether the machine corresponding to the random number is operating, and if so, for triggering the prize announcement means.

15. Apparatus for awarding prizes to users of a plurality of commercial laundry machines, comprising:

an activity interface coupled to each of the commercial laundry machines for providing an active signal when the laundry is operating;

digital display means for identifying a prize winner;

a controller coupled to the activity interface and the digital display means comprising a timer, a random number generator responsively coupled to the timer for generating a random number corresponding to one of the commercial laundry machines upon expiration of the timer, and logic circuit coupled to the random number generator for testing whether the laundry machine corresponding to the random number is operating, and if so, for triggering the digital display means.

16. Apparatus of claim 15, wherein the an activity interface comprises an interface circuit coupled to a source of power in one of the commercial laundry machines, the interface circuit comprising a rectifier for feeding current to an optoisolator, thereby providing an active signal when the laundry machine is operating.

17. Apparatus of claim 15, wherein the digital display means comprises a plurality of audible and visual signaling devices.

18. Apparatus of claim 15, wherein the digital display means comprises at least one numeric display for displaying a number corresponding to a winning laundry machine.

19. Apparatus of claim 15, wherein the timer comprises a digital timer integrated circuit.

20. Apparatus of claim 15, wherein the random number generator comprises a plurality of flip-flop circuits coupled to the timer, the flip-flops being coupled to a plurality of activity input lines from the commercial laundry machines, the flip-flops having a trigger input from the timer and a digital output activated in response to the trigger input.

21. Apparatus of claim 15, wherein the logic circuit comprises first and second monostables each coupled to a buffered clock input from the timer, the first monostables having an output coupled to a display decoder, the second monostable having an output coupled to the digital display means.

22. Apparatus for awarding prizes to users of a plurality of commercial laundry machines, comprising:

an activity interface coupled to each of the commercial laundry machines for providing an active signal when the laundry machine is operating;

digital display means for identifying a prize winner;

a controller coupled to the activity interface and the digital display means comprising a timer, a random number generator responsively coupled to the timer for generating a random number corresponding to one of the commercial laundry machines upon expiration of the timer, and a logic circuit coupled to the random number generator for testing whether the machine corresponding to the random number is operating, and if so, for triggering the digital display means, further including time of day sensing means for setting a time delay of the timer longer during off-peak hours of the establishment.

23. Apparatus of claim 22, wherein the time of day sensing means comprises a real time clock providing a digital output corresponding to the actual time of day, and a plurality of capacitors coupled to the clock and to the timer for setting the timer to a long time interval when the digital output of the real time clock is equal to a preset off-peak time.

* * * * *

UNITED STATES PATENT AND TRADEMARK OFFICE

CERTIFICATE OF CORRECTION

PATENT NO. : 5,217,224

DATED : June 8, 1993

INVENTOR(S) : Brent Sincock

It is certified that error appears in the above-identified patent and that said Letters Patent is hereby corrected as shown below:

In the Claims:

Column 6, line 30, after "awarding" insert -- prizes --.

Column 8, line 20, after "laundry" insert -- machine --.
Column 8, line 34, before "activity" delete "an".

Signed and Sealed this

Eighth Day of February, 1994

Bruce Lehman

*Attest:*

BRUCE LEHMAN

*Attesting Officer*

*Commissioner of Patents and Trademarks*